United States Patent [19]

Shames et al.

[11] 4,338,731

[45] Jul. 13, 1982

[54] VENT FOR A CLOTHES DRYER

[75] Inventors: Sidney J. Shames, Briarcliff Manor; Harold Shames, Ardsley, both of N.Y.

[73] Assignee: Melard Manufacturing Corporation, Passaic, N.J.

[21] Appl. No.: 189,663

[22] Filed: Sep. 22, 1980

[51] Int. Cl.[3] ..... F26B 11/04

[52] U.S. Cl. ..... 34/82; 34/86; 34/133; 34/235; 137/875; 137/881; 251/98

[58] Field of Search ..... 251/96, 98, 99; 137/544, 875, 881, 599.2; 55/213, 310, 313, 314, 481, 506; 34/82, 133, 86, 35, 235

[56] References Cited

U.S. PATENT DOCUMENTS

| | | | |
|---|---|---|---|
| 3,999,304 | 12/1976 | Doty | 34/82 |
| 4,011,662 | 3/1977 | Davis et al. | 34/82 |
| 4,120,285 | 10/1978 | Nugent | 126/443 |
| 4,122,612 | 10/1978 | Mrofchak | 34/235 |
| 4,137,647 | 2/1979 | Clark, Jr. | 34/82 |
| 4,156,973 | 6/1979 | Bede | 137/875 |
| 4,227,315 | 10/1980 | Hight | 34/133 |

*Primary Examiner*—L. I. Schwartz
*Attorney, Agent, or Firm*—Norman Lettvin

[57] ABSTRACT

An energy saving vent is provided for selectively directing hot, moist exhaust air from a clothes dryer either through a downstream vent sleeve to the outdoors, or through a vent port to the indoors. The vent includes four major components principally molded from a synthetic plastic resin, the components being: an open sided housing; a closure panel for closing one open side of the housing; a valve member within the housing for selectively directing air through the housing in alternate paths; and a filter screen assembly for another open side of the housing. The selectively swingable valve carries a pressure relief means adapted to provide for passage therepast of pressurized exhaust gas when the valve is in its position to direct air flow indoors, and in the event that the flow of air indoors is blocked by the filter screen being clogged. The preferred filter screen is a truncated, basket-like, member that is carried on a frame which is removably carried in a slide channel defined on the housing. The valve member is formed integral with an elongated pivot shaft. Opposed portions of the housing are formed to provide bearings within which the valve's pivot shaft is selectively pivotable, and axial slidable. Means are provided for latching the valve in each of its alternate positions.

25 Claims, 9 Drawing Figures

FIG. 5
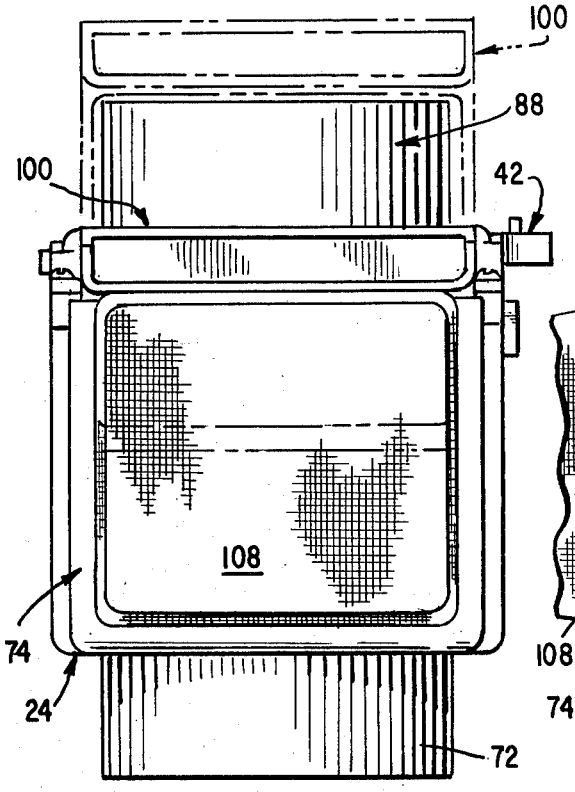
FIG. 6
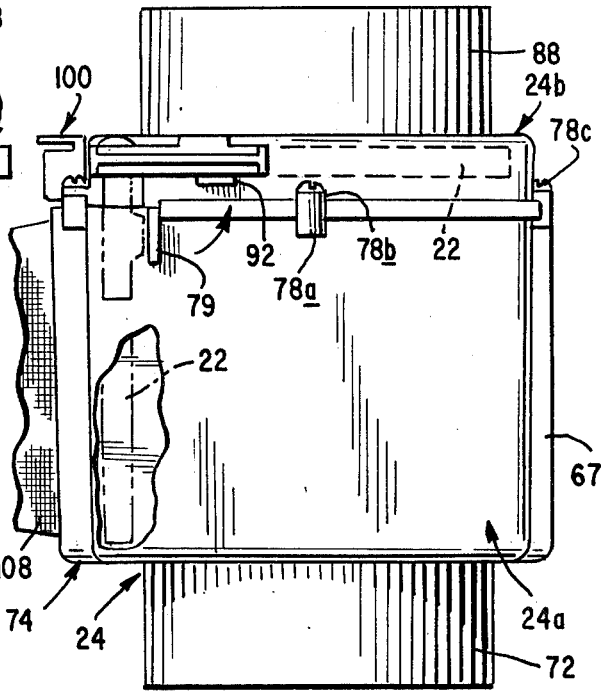
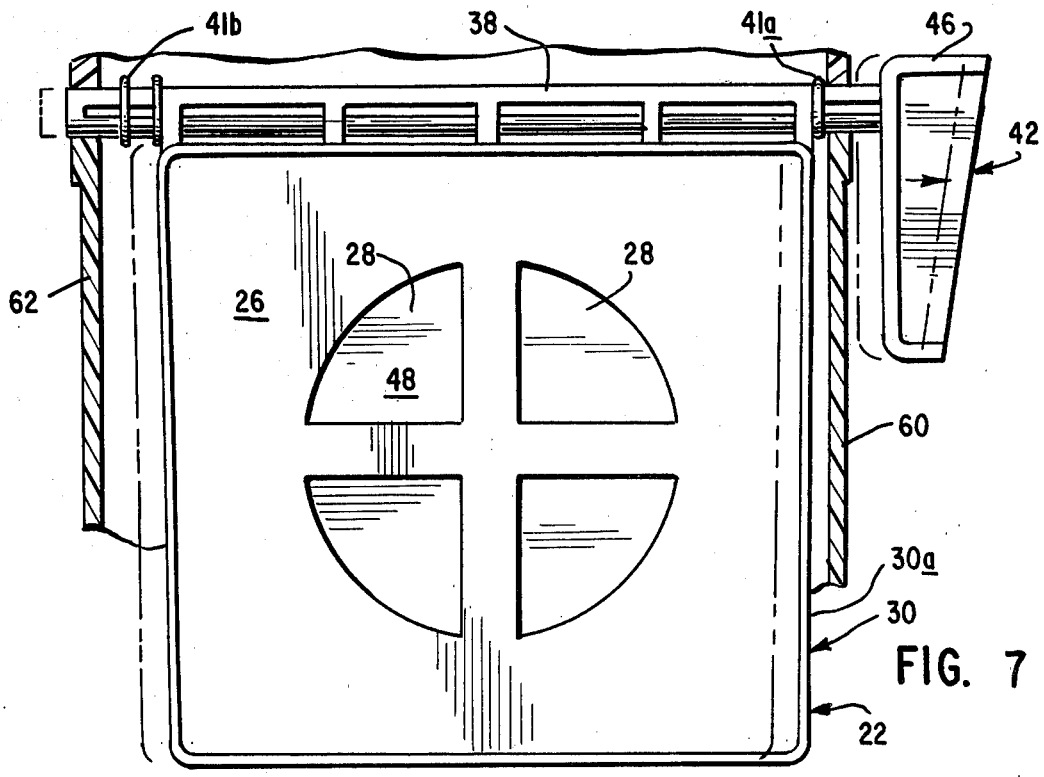
FIG. 7

FIG. 8
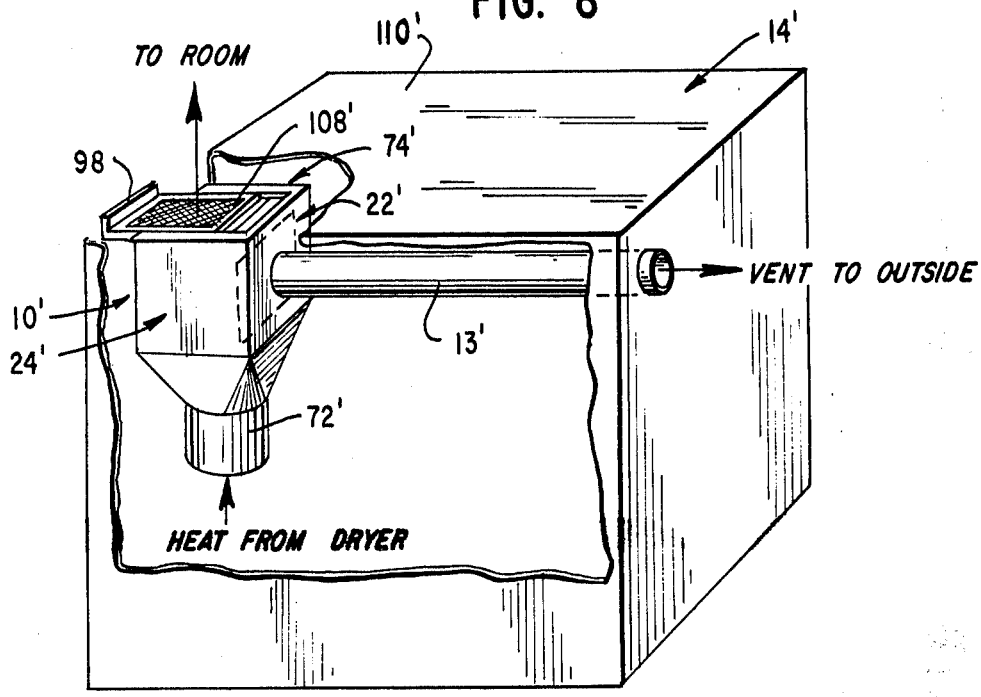
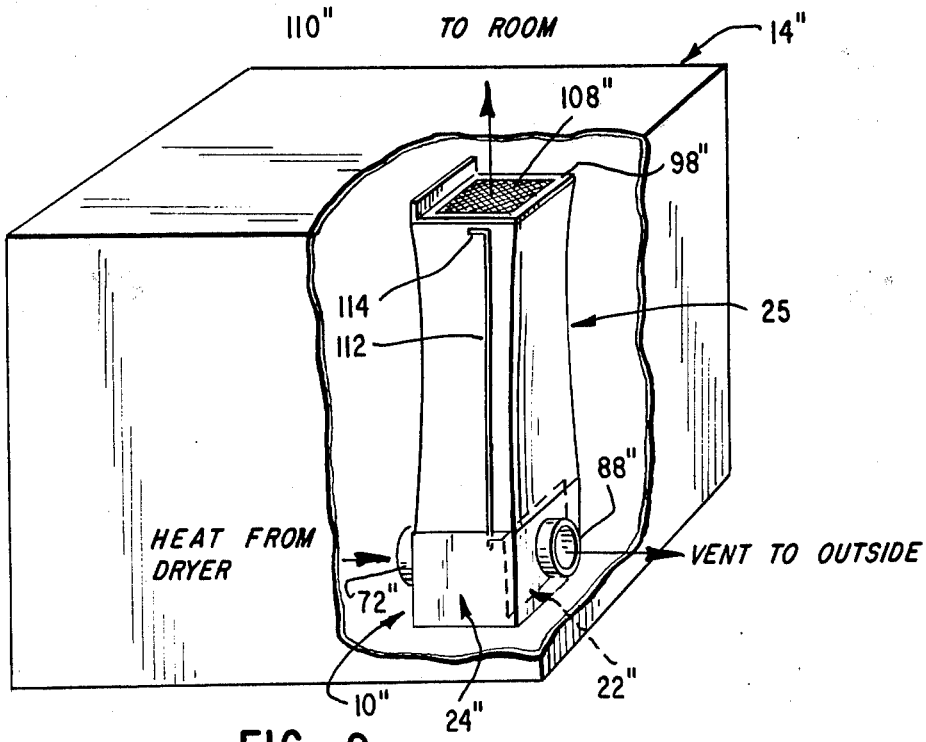
FIG. 9

VENT FOR A CLOTHES DRYER

FIELD OF THE INVENTION

This invention relates generally to an exhaust vent for a clothes dryer, and more particularly to an energy saving exhaust vent for selectively directing hot, moist air from the exhaust of a clothes dryer to the interior of a building for purposes of heating and humidifying during cold, dry winter months.

BACKGROUND OF THE INVENTION

U.S. Pat. Nos. 3,716,925; 4,011,662; 4,034,482; and 4,156,973 disclose energy saving vents adapted to direct hot, moist air exhausted from a domestic clothes dryer to the interior of a building. The operation of such dryers requires the expenditure of relatively large quantities of energy which, after the drying is complete, is normally lost to the atmosphere. The prior art patents noted disclose use of dryer exhaust air to increase the relative humidity and/or temperature within the building and to thereby reduce humidifying and heating costs.

Previous energy saving vents include lint-filtering traps which become clogged with lint and other particulate matter and operate to impede the flow of dryer exhaust air therethrough. An increase in resistance to disposing of exhaust air from the dryer could adversely affect the intended operation or efficiency of the dryer.

It is therefore an object of the present invention to provide an energy saving vent of inexpensive construction adapted to selectively direct exhaust air from a clothes dryer either outdoors or indoors, and which is constructed to provide a pressure-relief arrangement which insures proper functioning of the dryer.

Another object of the present invention is to provide an energy saving vent, formed of inexpensive molded construction that provides for selective discharge of heated air to the building when heating is desired, the vent being provided with a screen for capturing lint and particulate matter carried by the heated air, and which screen is readily removable to permit cleaning thereof.

A further object of the present invention is to provide a valved energy-saving vent of inexpensive construction formed with a pressure relief means therein that functions when heated air is being selectively directed through a lint filter with the area to be warmed by the heat energy of the air, and provided with a selectively removable lint filter, and wherein the valve within the vent is so constructed as to provide simple but effective means for releasably latching the valve in its alternate positions.

Still another object of this invention is to provide a valved energy-saving vent of inexpensive construction that may be conveniently incorporated into a clothes dryer as part of the original equipment of the clothes dryer.

These and other objects and advantages of the present invention will become apparent after reviewing the following drawings and detailed disclosure of a preferred embodiment.

SUMMARY OF THE INVENTION

There is disclosed herein an energy saving vent for hot air discharged from a clothes dryer, the vent being constructed principally of a high temperature resistant plastic and including therein a selectively swingable valve adapted to direct hot air emitted from the clothes dryer selectively either outdoors, when said valve is in a first, or summer, position, or indoors, when said valve is in a second, or winter, position. The energy saving vent comprises and provides a housing, molded of plastic, and having an upstream hot air entry sleeve, adapted to attach to and receive hot air from a clothes dryer exhaust hose, a downstream hot air exit sleeve, adapted to discharge hot air from the vent when the valve is in the first position, and a lateral indoor venting side, or port, adapted to receive hot air from the entry sleeve when the valve is in the second position. The valve is adapted to be selectively swung between the first position, wherein hot air flow through the indoor venting port is closed off and flow is directed through the exit sleeve, and the second position wherein hot air flow through the exit sleeve is closed off and flow is directed through the indoor venting port.

A lint filter is provided to removably cover the indoor venting port and capture lint and particles flowing therethrough. The filter includes a generally rectangular filter frame adapted to be slidably received by said housing and a screen secured thereto. In a preferred form, the screen is formed to provide an outwardly extending, frusto-pyramidal, wire mesh filtering basket. The central housing is provided with a peripheral filter-receiving slide channel formed adjacent the indoor venting port for slidably receiving and holding the filter frame therein. The filter frame is shaped to include an elongated grip for ease of manipulation of the frame in the mounting channel therefor.

The selectively swingable valve carries a pressure relief means thereon. The valve is a plate-like mamber having at least one centrally positioned opening therethrough, a resilient gasket adapted to cover and close the downstream side of the opening; a coil spring; and a disc adapted to be biased by said spring against the gasket which is then urged against the valve plate to normally prevent flow through said opening. The pressure relief member is adapted to respond to build up of air pressure, created by the exhaust air under a clogged-filter condition, to urge the gasket away from the plate and to provide pressure relief.

The central housing has a generally cuboid configuration and is defined by opposed, imperforate side panels, an imperforate back panel, an open front defining the lateral indoor venting port, and opposed top and bottom panels having openings therethrough communicating respectively with the outwardly extending, upstream hot air entry sleeve and the outwardly extending, downstream, hot air exit sleeve. The top panel is formed separately from the remainder of the central housing, but is constructed to cooperate with said central housing to complete the housing and to form two reinforced support bearings for the swingable valve. The support bearings are located one each in the two imperforate sides and in alignment adjacent the indoor venting side of the housing.

The swingable valve includes an elongated support shaft integrally formed with said valve plate, and is axially slidable, to limited extent, and swingably mounted within said support bearings of the housing. An elongated control handle for the valve is provided at one end of the shaft, integrally molded therewith. The housing wall adjacent the control handle includes spaced, outwardly extending, tabs adapted to cooperate with the control handle to selectively secure the valve alternatively in first or second positions corresponding with the first and second positions of the valve.

The shaft includes thereon axially spaced stop means adapted to cooperate with the inner side walls of the spaced bearings to limit the axial sliding movement of the shaft, between an axial position at which the valve may be swung between said first and second positions, and another axial position at which the handle is latched to hold the valve in the alternative positions.

BRIEF DESCRIPTION OF THE DRAWINGS

FIG. 5 is a front elevational view of the energy saving vent of FIG. 2, taken looking from the right of FIG. 4;

FIG. 6 is a fragmentary side elevational view of the energy saving vent of FIG. 2 showing the handle for the selectively movable valve in one alternate position;

FIG. 7 is an enlarged fragmentary view of the selectively movable valve of the vent, showing the upstream side of said selectively movable valve and illustrating in broken lines the alternate position of the valve's pivot shaft and handle;

FIG. 8 illustrates one modified form of this invention, showing one manner of incorporating a vent, such as shown generally in FIGS. 1–7, as original equipment in a clothes dryer; and FIG. 9 is similar to FIG. 8 showing another modified form of the combination of the vent in an original equipment clothes dryer.

DETAILED DESCRIPTION OF THE INVENTION

Figure 1:
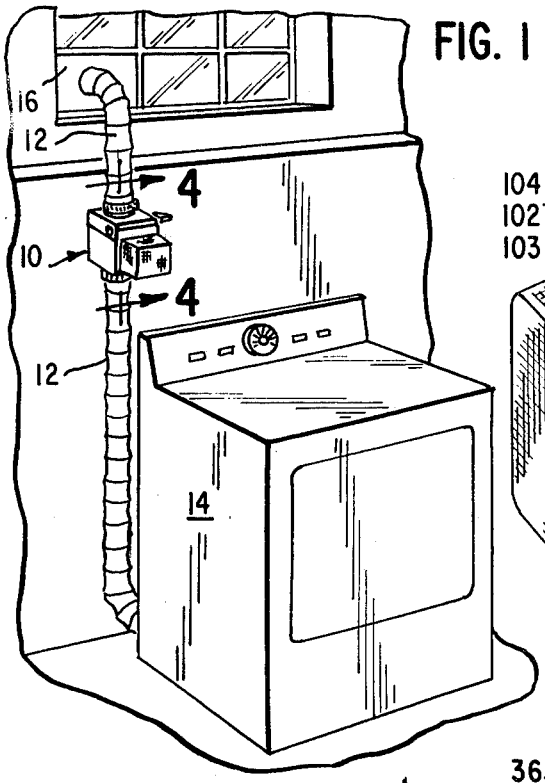
FIG. 1 is a perspective view illustrating the energy saving hot air vent of the present invention operatively interposed in the exhaust hose of a clothes dryer.

Referring now to the drawings and particularly to FIG. 1, the energy saving vent of the present invention is depicted generally as 10. Said vent 10 is shown interposed between ends of, and attached to, an exhaust hose 12 that normally extends from a typical clothes dryer 14 through a window 16 to the outdoors. Any type of conventional clamp may be employed to secure the ends of the exhaust hose 12 to the nipples, or sleeves, provided at the upstream (lower) and downstream (upper) sides of vent 10.

The vent 10 is formed of four molded components: (a) a selectively swingable planar valve member 22, best seen in FIGS. 3 and 7; (b) a housing part 24*a* with an open top, best seen in FIGS. 2–4; (c) a housing part 24*b*, best seen in FIGS. 2–4, that serves to close the open top of housing part 24*a*; and (d) a filter 25, best seen in FIGS. 2 and 4.

Figure 3:
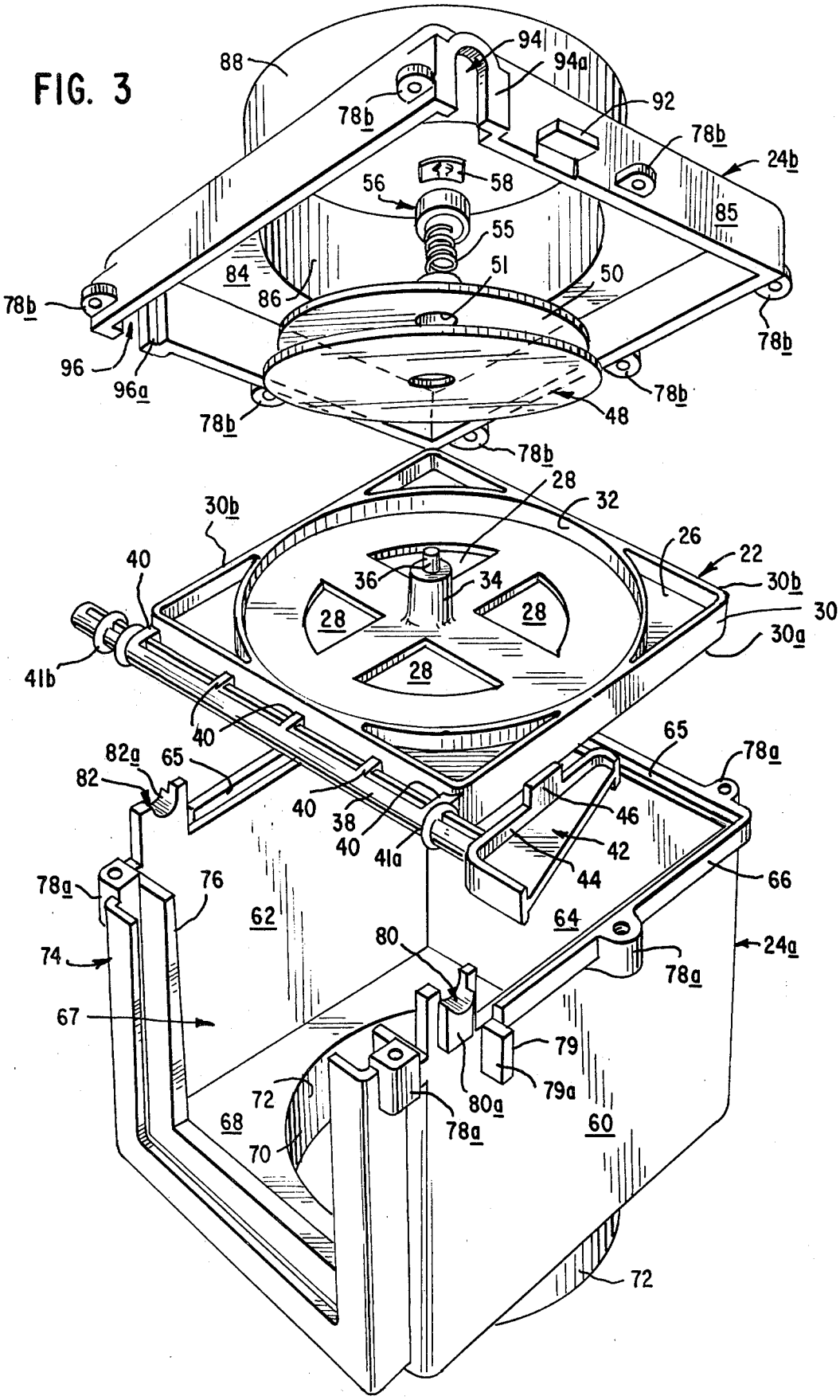
FIG. 3 is an exploded, enlarged, perspective view showing the components of the energy saving hot air vent, with the filter removed.

The selectively swingable valve, generally 22, shown exploded in FIG. 3, includes a generally square-shaped plate, or disc, 26 having a plurality of pie-shaped, generally centrally positioned, symmetrically spaced openings 28 formed therethrough. The plate 26 has formed integral therewith a peripheral flange 30 that projects transversely of plate 26 substantially equal distances from the plane of plate 26. A circularly shaped rib 32 is provided on one side of plate 26, and tangentially merges with the upper portion of flange 30, as seen in FIG. 3. Plate 26 carries thereon a centrally disposed upstanding stud 34, with a reduced nipple 36 at the outermost end thereof. Adjacent one of the edges of plate 24, and formed integrally with the plate 26, is an elongated pivot shaft 38 which connects to plate 26 by a plurality of spaced ribs 40, so that in effect plate 26 is cantilevered from pivot shaft 38. The shaft 38 is formed to include two spaced, abutment rings 41*a* and 41*b* which serve as stops or abutments to limit longitudinal movement of the shaft relative to the walls of the housing in which the pivot shaft 38 is journalled. A control handle 42 is formed integral with pivot shaft 38 at one end of the shaft. Handle 42 is formed with a flange 44 along a portion of the periphery of handle 42, for purposes of reinforcing the handle. An extension 46 on flange 44 projects from flange 44 to serve as a latching tab as described hereinafter.

The vent 10 is provided with a pressure relief system for venting hot exhaust air in the event the passage through which air is discharged indoors becomes clogged. The pressure relief system provides for air flow through the openings 28 in plate 26 upon the pressure in the housing, defined by parts 24*a* and 24*b* reaching a predetermined level. Normally the openings 28 are closed by use of an annular sealing gasket 48 whose peripheral edge is pressed against an imperforate annular seat 26*a* on plate 26 that surrounds openings 28. This pressure against gasket 48 is achieved through a molded pressure plate 50 of slightly concave shape as shown, so that pressure against gasket 48 is effected outwardly of openings 28. Pressure plate 50 is centrally bored at 51 to slide fit over stud 34. An upstanding sleeve 54 formed on the back side of pressure plate 50 is spaced from stud 34 to provide an annular recess for receiving the lower end of helical compression spring 55. The spring 55 is retained in position, to exert the pressure on plate 50 to effect sealing pressure on gasket 48, by a cup-shaped spring retainer 56 whose cylindrical wall 57 surrounds the upper end of sleeve 54. The bottom of cup-shaped retainer 56 is apertured to slidably fit onto nipple 36. The assembly is retained in position by an apertured spring retainer 58, of the type well known in the art. The spring retainer is press fit onto nipple 36 and is shaped as shown with teeth adjacent the aperture thereto which grip the nipple 36 to hold the parts assembled. The cup-shaped retainer 56 compresses spring 55 to develop the required force to be applied to gasket 48.

Figure 2:
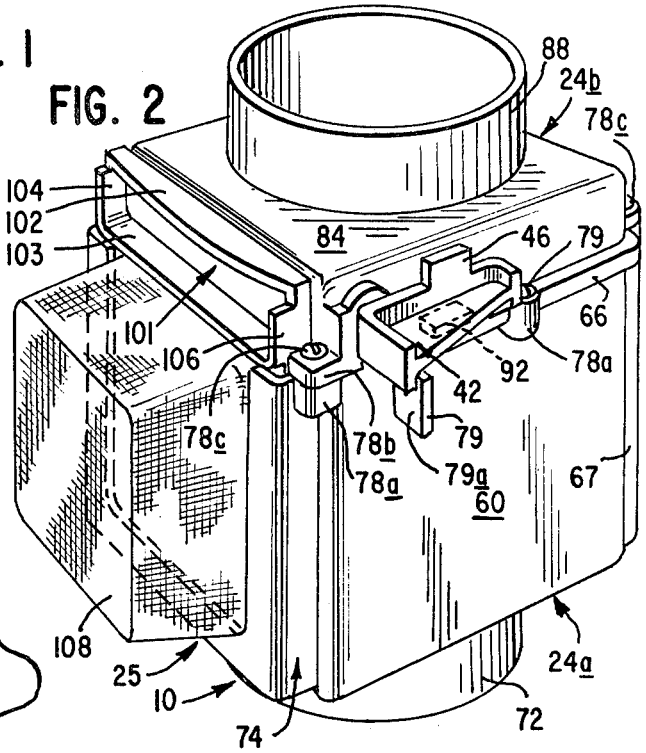
FIG. 2 is a perspective view of the energy saving hot air vent of the present invention.
Figure 4:
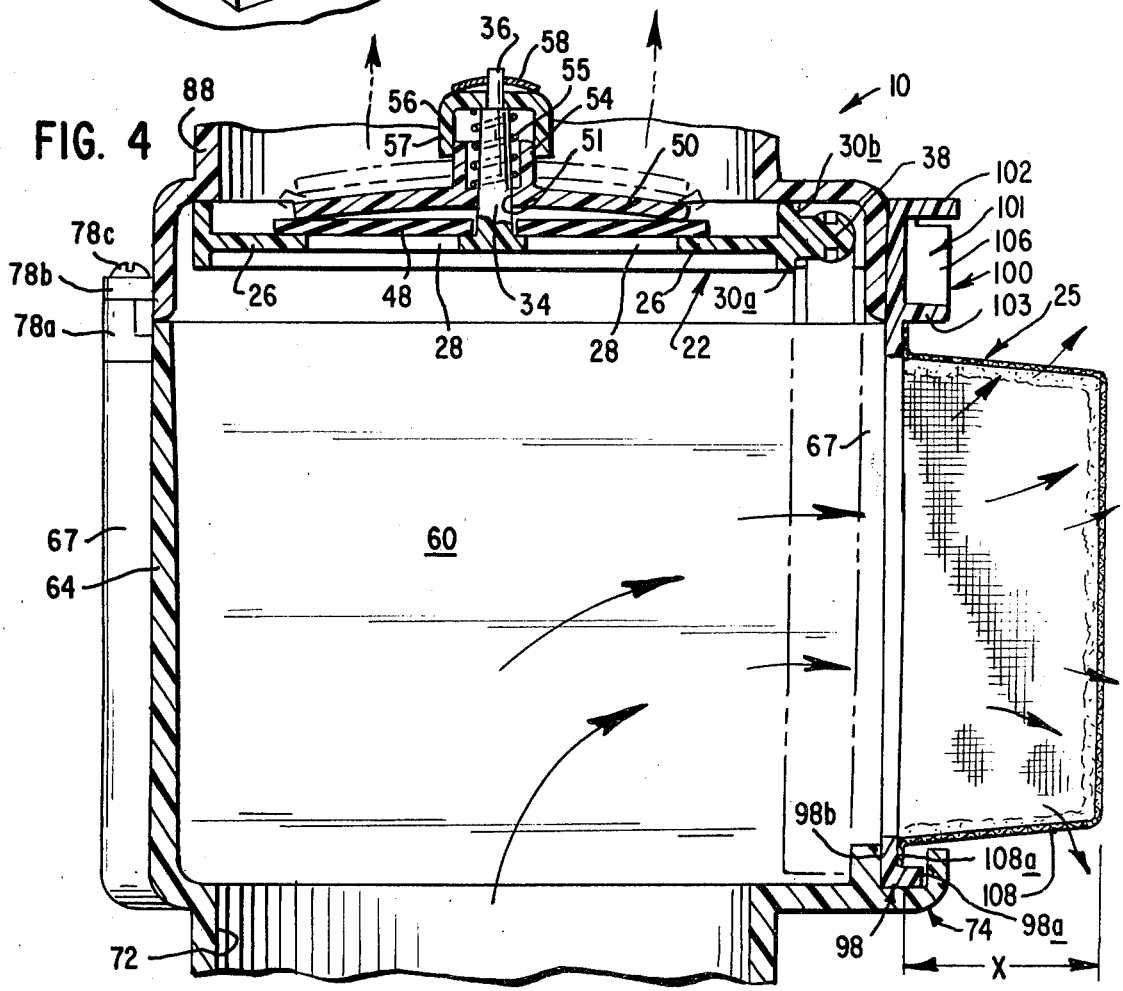
FIG. 4 is an enlarged, vertical, cross-sectional view taken substantially along line 4—4 of FIG. 1 showing details of the selectively swingable valve of the vent, and of the preferred form of filter.

The vent housing 24 has a generally cuboid configuration as seen in FIGS. 1, 2 and 4, defined by the connection of housing parts 24*a* and 24*b*. Housing part 24*a* is formed and shaped to provide a pair of generally parallel, spaced side panels 60 and 62 which are integral with a back side panel 64, and frame means bounding an open front side 67 that is opposite back panel 64. All said panels and frame means are integral with a bottom panel 68 having a central opening 70 that is surrounded by a downwardly extending nipple 72 that serves as the upstream connection for exhaust hose 12.

The open front side 67 is bounded on three sides by a U-shaped frame 74 that is of channel-shaped cross-section to provide a slideway for receiving thereinto a selectively mountable filter. The inner surface 76 of frame 74 is adapted to cooperate with the lower peripheral edge 30*a* of flange 30 on valve 22 to provide a substantial seal therebetween.

The upper edge of housing part 24*a* is reinforced with an enlarged frame bead 66 formed integral with walls 60, 62 and 64. Portions of reinforcing bead 66 are enlarged at 78*a*. A pair of reinforcing ribs 67 extend vertically along back wall 64, terminating at the two outermost enlargements 78*a*. The free ends of the legs of U-shaped frame 74 are also provided with enlargements 78*a*. Said enlargements 78*a* are tapped to receive thereinto assembly screws 78*c* for securing together housing parts 24*a* and 24*b*. The bead 66 projects above the upper edges of walls 60, 62 and 64 to provide a stepped recess 65 which cooperates with portions of housing part 24*b* to insure proper telescoping when housing parts 24*a* and 24*b* are assembled.

The side 60 of the housing part 24*a*, which is the side adjacent which handle 42 is located, further has formed thereon an outwardly-extending tab 79 that is adapted to operatively co-act with the tab 46 of the control handle 42. The portions of opposed walls 60 and 62 that are adjacent the open front 67 of housing part 24*a* are shaped and formed to provide upwardly opening saddles 80 and 82 the bight portions of which serve as journals for pivot shaft 38. The walls 60 and 62 have enlargements 80*a* and 82*a* formed thereon to provide lengthening of the journals for shaft 38.

The housing part 24*b* is formed and shaped to dimensionally and configurationally cooperate with housing part 24*a* to provide the closed housing 24 as seen in FIGS. 2, 4, 5 and 6. Housing part 24*b* is generally of square shape to provide a top wall 84 of the housing 24, with a depending peripheral skirt 85. The top wall 84 has a central opening 86 formed therethrough that is surrounded by downstream sleeve, or nipple, 88. The skirt 85 is formed to provide a plurality of apertured tabs 78*b* that correspond to enlargements 78*a* on housing part 24*a*, the apertures in the tabs providing for the shank of assembly screws 78*c* to pass therethrough when screws 79 are screwed into enlargements 78*a*. The size and shape of skirt 85 is such as to telescope into peripheral recess 65 defined on housing part 24*a*. Skirt 85 is also shaped and formed to provide a latch tab 92 thereon on the portion of skirt 85 aligned with sidewall 60 of the housing part 24*a*. Tab 92 is positioned and arranged for cooperation with handle 42 when the valve 22 is in the position generally illustrated in FIG. 3 and when the upper peripheral edge 30*b* of flange 30 engages the underside of housing top wall 84 to provide a substantial seal between flange 30 and top wall 84. Additional sealing is provided when the upper edge of circular flange 32 engages the underside of the housing's top wall 84.

The skirt 85 is further formed to provide downwardly opening upper saddles 94 and 96 which cooperate respectively with lower saddles 80 and 82 on housing part 24*a*. The upper saddles 94 and 96 are elongated to provide additional bearing surface for cooperation with pivot shaft 38. The enlargements 94*a* and 96*a* on skirt 85 are of such a size and shape as to embracingly telescope over enlargements 80*a* and 82*a* formed on housing part 24*a*, and interlock to prevent distortion.

The saddles 80 and 82 on housing part 24*a* and saddles 94 and 96 on housing part 24*b* are so positioned that with pivot shaft 38 journalled in said saddles the lower seal edge 30*a* and upper seal edge 30*b* on valve 22 will respectively engage and seal against wall portion 76 and wall portion 84 when the valve 22 is in the two alternate positions therefor.

The spacing of side walls 60 and 62 is so related relative to the size of valve 22 that valve 22 and pivot shaft 38 may be shifted selectively within housing 24 in directions parallel to the longitudinal axis of pivot shaft 38.

The axial sliding movement of pivot shaft 38 is limited by the positioning of abutments 41*a* and 41*b*, in the form of rings or enlargements on the pivot shaft 38, with shifting to the right, as viewed in FIG. 3, being limited when abutment 41*a* engages the inner surface of wall 60 adjacent saddle 80, and shifting to the left being limited when abutment 41*b* engages the inner surface of wall 62 adjacent saddle 82.

When the pivot shaft 38 and valve 22 are shifted to the right, considering the view in FIG. 3, the handle 42 on shaft 38 is then in position to avoid engagement with latch tabs 79 and 92, and a person may freely control movement of valve 22 between its two alternate positions of either blocking flow through downstream nipple 88 or blocking flow through open side 67. When pivot shaft 38 is shifted to the left, considering the view in FIG. 3, then the handle 42 may be latched in either of the two alternate positions selected.

The connection of pivot shaft 38 to peripheral flange 30, through the plurality of equally spaced ribs 40 provides that when flange 30 is in either of its abutting positions against top wall 84, or against inner surface 76 of frame 74, there exists a resiliency such that the control handle 42 may be moved, or sprung, beyond its normal position into a latching position, and then the force from the sprung handle, operating through resilient shaft 38 and ribs 40 acts to hold flange 30 more tightly against the walls 84 or 76 in the abutting positions, thereby creating a better seal. Thus, with the underside of handle 42 engaging tab 92, as seen in FIG. 2, latching is effected with the valve 22 in position to block flow into downstream nipple 88, except if a high pressure condition in housing 24 unseats the resilient gasket 48 of the pressure relief valve, as illustrated by broken lines in FIG. 4. With tab 46 engaging tab 79 against face 79*a*, latching is effected with valve 22 in position to block flow through open housing side 67.

More specifically, with the shaft 38 pushed axially inward, or to the left considering the view in FIG. 3, also shown in broken lines in FIG. 7, abutment ring 41*b* will contact and be stopped by housing wall 62. In that position, the vertically disposed tab 79 may be used to prevent counter-clockwise rotation when the valve 22 is vertically positioned to direct flow to the outdoors, and/or the underside of control handle flange 44 may be used to contact and be stopped by the horizontally disposed tab 92 to prevent clockwise rotation when the valve 22 is horizontally positioned to direct flow to the indoors. However, when the control handle 42 is pulled axially out, to the full line position in FIG. 7, where abutment ring 41*a* will contact and be stopped by housing wall 60, the control handle 42 is in position to clear the tabs 79 and 92, the handle 42 is free to swing or rotate. When the shaft 38 is disposed in the axially outer position, clockwise rotation of the shaft 38 within the bearings is stopped when edge 30*b* of the flange 30 of the valve 22 contacts the interior surface 76 of the channel 74, and counter-clockwise rotation of the shaft 38 is stopped when the edge 30*a* of the flange 30 contacts the interior surface of side 84 on housing part 24*b*. By reason of the features disclosed above, including the fact that flanged plate 26–30 is smaller in size than the walls of housing 24, the angle of swing between the two alternate positions for valve 22 may be any selected amount including more than 90°, although preferably the angle of swing between the two alternate positions is 90°.

The lint filter 25, best shown in FIGS. 2 and 4, includes a generally rectangularly-shaped, unitary molded frame member 98, the sides of which are dimensioned to be slidably received within the channel 74 which surrounds the periphery of the open front side 67 of the housing part 24*a*. The upper portion 100 of the frame 98, which extends above the terminal ends of the U-shaped channel 74, is shaped to provide a finger grip recess 101 bounded by transversely projecting, elongated flanges 102 and 103, rigidified by shorter, transverse side flanges 104 and 106. The upper elongated flange 102 is shaped to provide a good finger grip. The frame member 98 is of a size with peripheral flange 98*a* to fit, slidably without wobble, into the length, width, and depth of channel 74. A wire screen, of a fine enough mesh for capturing airborne lint and the like, is secured to and extends from the base frame 98. The screen may be a planar one, such as shown for example in FIGS. 8 and 9, or of any other shape, but preferably the screen is in the form of a basket, such as an outwardly-extending, frusto-pyramidal shaped member 108. The screen 108 has a peripheral portion 108*a* that permits securement by gluing, adhesive, or welding to a reduced frame portion 98*b*. The frusto-pyramidal shape of screen 108 is operative to provide an enlarged filtering surface area compared to the limited size of a flat screen that would be positioned across open side 67.

In the following description of other forms of the invention, parts corresponding generally to those described hereinabove are identified by the same numeral used above, supplemented by a prime (') or double prime (").

In the energy saving clothes dryer devices shown generally in FIGS. 8 and 9, and which constitute other forms embodying the invention, a vent of the general type described hereinabove is incorporated as part of the original equipment of the clothes dryer from which heated, moist air, from the drying of wet washed clothes, is to be discharged. Thus, FIG. 8 illustrates a modified form of clothes dryer 14', of generally box-like, walled, exterior configuration, provided with a casing of sheet metal walls for enclosing therein the mechanism of a clothes dryer, as well known in the art. The particular form of dryer 14' has the upper, or top, wall 110 of the casing formed with an opening therein through which there may be selectively effected a discharge of moist heated air to the room or region in which the dryer 14' is located.

Within the casing of dryer 14' there is positioned a vent 10', constructed and arranged to receive therein heated and moist discharge air through an upstream sleeve, or nipple, 72' from the dryer mechanism (not shown). The vent 10' includes a box-like walled housing 24' which receives thereinto the moist heated air from upstream nipple 12'. The housing 24' includes therein a selectively movable valve 22' (shown in phantom), and the casing is provided with two alternate discharge passageways therefrom. The first alternate discharge passageway is a tubular vent 13 that is intended to convey and discharge hot moist air through one of the walls of the dryer's casing and from thence outdoors of the building in which dryer 14' is located. The other discharge passageway is for directing moist heated air indoors into the room, or space in which the dryer 14' is located. The side of housing 24', through which air passes for discharge indoors is generally shown at 74'. Side 74' preferably includes a slide channel, corresponding with channel 74 disclosed in the description of FIGS. 1–7 above. The housing 24' is itself mounted or secured on the dryer's casing by any appropriate means such as by attachment to side 110 of the dryer's casing. A frame-mounted screen 108' is carried by a frame 98' that is slidably positioned in the channel 74'. A handle for selectively actuating the valve 20' between alternate positions, as disclosed in the description of FIGS. 1–7 above, is provided but not shown in FIG. 8. Such handle may be constructed to protrude from the casing for dryer 14' or may be actuated through an extension member that extends outwardly from the casing.

In FIG. 9, another form of dryer incorporating a vent of the type illustrated in FIGS. 1–7 is disclosed. Here, dryer 14" carries therewithin, and adjacent the lower wall of the dryer's casing, a vent, generally designated 10" that includes a housing 24" having an upstream inlet nipple 72" and a downstream outlet nipple 88". The downstream outlet nipple 88" is adapted to direct hot moist air through conduit means (not shown) to the outdoors. The dryer 14" includes a casing whose upper wall 110" is apertured to provide access to a removable screen 108" that is located at the discharge end of a hollow extension 25 of the housing 24". As seen in FIG. 9, the housing 24" connects to a vertically extending duct 25 whose upper end terminates at, or in alignment with, an opening in top side 110" of the dryer's casing. The duct 25 is preferably provided at its distal, or upper, end with a channel-shaped slideway for slidably receiving the frame 98" for a screen 108". The duct 25 may have shaped walls, as shown, to provide a Venturi effect in connection with the movement of air therethrough as it is being discharged from the structure 24"–25". A valve 22" within housing 24" is arranged to be selectively manipulated through an elongated control rod 112 which provides, at its upper end, a control handle 114. The valve 22", shown in phantom, may be selectively positioned, vertically as shown, for closing off air flow to the downstream nipple 88", or alternatively in a horizontal position to cut off discharge flow from casing 24" into duct 25.

While the lint-collecting screen 108 is shown as having an effective support dimension that is determined by the size of screen frame portion 98*b*, which in turn is less than the slide channel size of U-shaped frame 74, it will be appreciated that neither the support size of screen 108, nor the size of frame 74, nor the size of frame portion 98*b* is required to be limited by the dimensions of the other housing portions of vent 10. Thus, it is contemplated that the vent's open front side 67 may be made larger than presently shown vis-a-vis the vent's housing, and the frame portion of the housing that is designed for holding the screen could be shaped in the form of an outwardly flared opening, with a connection means provided adjacent the outermost edges of said flared opening and adapted to have attached thereto a screen with a much greater edge dimension than that presently reflected in the drawings herein.

It is also contemplated that the housing for a modified form of the vent 10 may be formed to provide thereon a second selective attachment means located downstream of U-shaped frame 74 and being substantially a duplicate of frame 74 so that with a flat screen, like 108', positioned in the U-shaped frame 74, a flanged tubular adapter or sleeve, that constitutes part of a duct, may be connected to the second attachment means, thereby providing a nipple (not shown) for a length of ducting that is to convey indoors-discharged air distally of vent 10 to another region, or room, of the house in which the dryer is located. The flanged tubular adapter will be shaped and constructed to provide the same cross-sectional flow area as that provided by the outlet nipple 88.

While various inventions and forms thereof have been described, it will be understood that the inventions may be utilized in other forms and environments, so that the purpose of the appended Claims is to cover all forms of devices not disclosed but which embody the inventions described herein.

What is claimed is:

1. In an energy saving hot air vent which includes a selectively swingable, air-directing, valve adapted to direct hot air emitted from a clothes dryer either outdoors, when said valve is in a first position, or indoors when said valve is in a second position; said energy saving vent including housing means having an upstream hot air entry means adapted to receive thereinto hot air from a clothes dryer exhaust hose segment, a downstream hot air exit means adapted to direct hot air from said housing to another exhaust hose segment when said valve is in said first position, and indoor venting port defined in said housing means and adapted to receive hot air from said hot air entry means for discharge therethrough when said valve is in said second position; the improvement comprising, in combination:

said housing means being molded from a heat-resistant plastic, a slideway formed integrally on the exterior of said housing adjacent to but positioned outwardly of the indoor venting port, a frame for selective slidable entry in and removal from said slideway, and a screen secured along its periphery to said frame and arranged for positioning across the direction of air flow from said indoor venting port for capturing lint and particulate matter carried by the heated air being discharged through said indoor venting port.

2. A construction as in claim 1 wherein said screen is a shape-sustaining wire mesh member in the form of a basket and extending outwardly of the frame and the housing means.

3. A construction as in claim 2 wherein the form of the shape-sustaining wire mesh screen is generally frusto-pyramidal.

4. A construction as in claim 1 wherein said frame is formed to provide grip means thereon for aiding in manual insertion and removal of the frame and screen in the slideway.

5. In an energy saving hot air vent which includes a selectively swingable, air-directing, valve adapted to direct hot air emitted from a clothes dryer either outdoors, when said valve is in a first position, or indoors when said valve is in a second position; said energy saving vent including walled housing means having an upstream hot air entry means adapted to receive thereinto hot air from a clothes dryer, a downstream hot air exit means adapted to direct hot air from said housing means when said valve is in said first position, and an indoor venting port defined in said housing means and adapted to receive hot air from said hot air entry means for discharge therethrough when said valve is in said second position; the improvement comprising, in combination:

the swingable, air-directing, valve in said housing means including a molded disc-like planar member mounted to be pivotable about an axis parallel to the plane of the planar member, said planar member being shaped to provide integrally thereon molded peripheral seal flange means located on opposite sides of the disc and projecting transversely of a medial plane of the disc;

the housing means providing on the interior thereof planar abutment surfaces adjacent to and surrounding both the indoor venting port and the downstream hot air exit means, said abutment surfaces each being constructed and arranged to be engaged and abutted by the peripheral edges of one of the peripheral seal flange means on the swingable planar member, depending upon whether the valve is in the first position or the second position, to effect a substantial engagement seal between the seal flange means of the air-directing valve and the housing means.

6. In an energy saving hot air vent means which includes: a walled housing means having defined therein an upstream hot air entry means adapted to receive therethrough hot air that exhausts from a clothes dryer into said housing means, a first downstream air exit port means constructed to receive and direct hot air from within the housing means toward outdoors, a second downstream air exit port means constructed to receive and direct hot air from within the housing means toward indoors, and valve means within said housing means selectively operable for directing the hot air received within the housing means either toward outdoors or toward indoors; the improvement comprising, in combination:

the housing means being shaped and arranged to provide on the interior thereof a pair of walls transverse to each other, each wall of said pair of transverse walls being shaped to provide an air flow aperture therethrough surrounded by a planar abutment surface, the aperture through the first of said pair of walls being part of the first downstream air exit port means, the aperture through the second of said pair of walls being part of the second downstream air exit port means; said valve means including a planar air-directing valve member that is swingable, about an axis that is parallel to the plane of said planar member, between a first position, at which one side of the planar member abuts the abutment surface of the second wall, so that when hot air is received within the housing means it will be caused to be directed through said first air flow aperture toward outdoors, and a second position, at which the opposite side of the planar member abuts the abutment surface of the first wall, so that when hot air is received within the housing means it will be caused to be directed through said second air flow aperture toward indoors; the planar member of the air-directing valve being integrally molded with pivot shaft means whose effective length is greater than the minimum spacing of a pair of spaced wall of the housing means between which the air-directing valve is positioned for said selective swinging; and the housing means comprising two molded parts adapted to be secured together to define the housing means and, when so secured together, to define journal means for said pivot shaft means.

7. A construction as in claim 6 wherein the size of the walls of the housing means in which the indoor venting port and the downstream hot air exit means are located is greater than the size of the air-directing valve, to the extent permitting limited selective movement by the valve in the housing means in opposite directions parallel to the pivot axis of the pivotable valve.

8. A construction as in claim 6 wherein one of the two molded parts is shaped and constructed to provide one apertured wall for the housing means and has integrally molded with said one wall a tubular mounting sleeve that is adapted to slidingly receive thereover and clamped thereagainst a resilient hose; and wherein the second of said two molded parts is shaped and constructed to provide all the other walls of said housing means including one apertured wall having integral therewith a tubular mounting sleeve that is adapted to slidingly receive thereover and clamped thereagainst a resilient hose.

9. A construction as in claim 8 wherein the second molded part is shaped to provide both an open wall and slideway adjacent said open wall.

10. In an energy saving hot air vent means which includes: a walled housing means having defined therein an upstream hot air entry means adapted to receive therethrough hot air that exhausts from a clothes dryer into said housing means, a first downstream air exit port means constructed to receive and direct hot air from within the housing means toward outdoors, a second downstream air exit port means constructed to receive and direct hot air from within the housing means toward indoors, and valve means within said housing means selectively operable for directing the hot air received within the housing means either toward outdoors or toward indoors; the improvement comprising, in combination:

the housing means being shaped and arranged to provide on the interior thereof a pair of walls transverse to each other, each wall of said pair of transverse walls being shaped to provide an air flow aperture therethrough surrounded by a planar abutment surface, the aperture through the first of said pair of walls being part of the first downstream air exit port means, the aperture through the second of said pair of walls being part of the second downstream air exit port means; said valve means including a planar air-directing valve member that is swingable, about an axis that is parallel to the plane of said planar member, between a first position, at which one side of the planar member abuts the abutment surface of the second wall, so that when hot air is received within the housing means it will be caused to be directed through said first air flow aperture toward outdoors, and a second position, at which the opposite side of the planar member abuts the abutment surface of the first wall, so that when hot air is received within the housing means it will be caused to be directed through said second air flow aperture toward indoors; and the planar valve member carrying thereon a pressure relief valve that is constructed to permit relief of buildup of air pressure in the housing means through said pressure relief valve when the air-directing valve member is in said second position.

11. In an energy saving hot air vent which includes a selectively swingable, air-directing, valve adapted to direct hot air emitted from a clothes dryer either outdoors, when said valve is in a first position, or indoors when said valve is in a second position; said energy saving vent including housing means having an upstream hot air entry means adapted to receive thereinto hot air from a clothes dryer, a downstream hot air exit means adapted to direct hot air from said housing means when said valve is in said first position, and an indoor venting port defined in said housing means and adapted to receive hot air from said hot air entry means for discharge therethrough when said valve is in said second position; the improvement comprising, in combination:

the housing means being generally cuboid; the swingable, air-directing, valve being movable within said cuboid housing and incuding a pivotable planar member that is integrally molded with elongated pivot shaft means that lies in a projection of the plane of the planar member adjacent to but outwardly of an edge of said planar member of said air-directing valve;

the edge size of the planar member, measured parallel to the axis of said pivot shaft means, being less than the spacing between a pair of opposed parallel walls of the housing means between which said planar member is arranged to be swung, so as to permit the planar member to be freely swung within the cuboid housing;

the effective length of the pivot shaft means being greater than the spacing of said opposed parallel walls; and journal means defined in said pair of parallel walls of the housing means and adapted to receive portions of the pivot shaft means to support the pivot shaft means and the pivotable planar member, and permitting selective, limited, axial movement of the pivot shaft means in opposite directions relative to the journal means.

12. A construction as in claim 11, including a control handle integrally molded with one end of the pivot shaft means, and being located outwardly of the housing means.

13. A construction as in claim 12 including abutment means on the pivot shaft means adapted to engage one of the parallel walls to limit axial movement thereof.

14. A construction as in claim 13 including arcuately spaced latching shoulders provided formed on the exterior of the housing means for latching cooperation with said control handle to permit releasable latching of the swingable valve in each of the two selected positions whereat the valve is either in its first or second positions.

15. A construction as in claim 14 wherein the latching cooperation between the control handle and each of the arcuately spaced latching shoulders requires resilient stressing of the pivot shaft means that transmits a resilient bias from the pivot shaft to the swingable planar member to resiliently force the planar member in sealing relation against an adjacent wall of the housing means in each of the said first or second positions.

16. In an energy saving home clothes dryer, from which heated moist air, from the drying of wet washed clothes, is discharged, the improvement comprising, in combination:

a walled dryer casing enclosing a clothes dryer mechanism;

one wall of said dryer casing having an opening therein adapted for selective discharge of moist heated air into an indoor region in which the casing is located;

a walled vent housing formed of a heat-resistant plastic mounted substantially entirely within said dryer casing and positioned so that one wall of said vent housing is so located adjacent said opening in the dryer casing as to be accessible from the outside of said dryer casing, said accessible side of the vent housing being normally open for air flow therethrough;

the walled vent housing having an upstream inlet connection for receiving heated moist air thereinto from the clothes dryer mechanism, and a downstream outlet connection through which heated moist air may be selectively discharged from the vent housing, to be vented through a wall of the dryer to outdoors without discharging moist heated air indoors;

a movable valve in said vent housing, for selectively directing moist heated air that enters the vent housing from the clothes dryer mechanism either through said open side of the vent housing or through the downstream outlet connection;

means manually operable from exterior of the casing for selectively positioning the movable valve in one or the other of said positions;

and a manually removable and insertable screen means positioned across the open side of the vent housing and outwardly of said casing.

17. A device as in claim 16 wherein the open side of the vent housing has a slide-receiving groove defined thereon, adapted for removably holding the removable screen means therein.

18. In an energy saving hot air vent which includes housing means shaped and arranged to provide an air inlet through which heated air from a clothes dryer enters the housing means, and two outlets adapted to have the heated air, that enters the housing, directed selectively to pass from the housing through only one selected outlet; the improvement comprising, in combination: the housing means being generally cuboid shaped and arranged to provide two adjacent walls that lie transverse to each other with each wall having located therein only one of said two air outlets, and two spaced parallel wall means each of which lies in a plane intersecting the plane of each of said two walls with an air outlet therein; each of said two adjacent transverse walls providing thereon an interior planar surface that surrounds, and is of greater dimension than, the outlet opening in said wall and each wall being shaped to provide a planar valve seat surrounding the adjacent air outlet and adapted for receiving a valve member in abutment thereagainst in a manner to substantially block air flow between said valve member and the abutted interior surface of the wall; a single air-directing valve member located within the housing means and arranged to be swung between alternate positions where the valve member abuts against one or the other of said two adjacent transverse walls, in air-flow blocking relation with said planar valve seat on the wall; said valve member being of a limited size to be located between and spaced from said two parallel wall means in all positions of said swinging movement between said abutting positions against said one or the other of said adjacent transverse walls; and valve moving means operatively associated with the valve member, and journalled in said parallel wall means, for selectively moving said valve member from one said alternate position to the other said alternate position.

19. In an energy saving hot air vent which includes housing means shaped and arranged to provide an air inlet through which heated air from a clothes dryer enters the housing means, and two outlets adapted to have the heated air, that enters the housing, directed selectively to pass from the housing through only one selected outlet; the improvement comprising, in combination: the housing means being shaped and arranged to provide two adjacent walls that lie transverse to each other with each wall having located therein only one of said two air outlets, and two spaced parallel wall means each of which lies in a plane intersecting the plane of each of said two walls wth an air outlet therein; each of said two adjacent transverse walls providing thereon an interior surface that surrounds the outlet opening in said wall and is shaped to provide a valve seat surrounding the adjacent air outlet and is adapted for receiving a valve member thereagainst in a manner to substantially block air flow between said valve member and the abutted interior surface of the wall; a single air-directing valve member located within the housing means and arranged to be swung between alternate positions where the valve member abuts against one or the other of said two adjacent transverse walls, in air-flow blocking relation with said valve seat on the wall; valve moving means operatively associated with the valve member, and journalled in said parallel wall means, for selectively moving said valve member from one said alternate position to the other said alternate position; and the single valve member carrying thereon a one-way relief valve means that is normally biased to a closed-valve position, but which is constructed and arranged to open under built-up pressure of air in the housing means.

20. A construction as in either claim 18 or claim 19 wherein a first one of said two air outlets is associated with a first means for discharging heated air into an indoor space where the heated air is used for space heating purposes, and the second one of the two air outlets is associated with a second means for discharging heated air to the outdoors.

21. A construction as in claim 20 wherein a portion of the housing means, adjacent to the first one of said air outlets, is shaped to provide a slideway with an open edge; a frame constructed and arranged for selective slideable entry into said slideway through said open edge thereof; and screen means carried by said frame and adapted to be positioned relative to sad first air outlet for capturing lint and particulate matter that is carried by the heated air that discharges from the clothes dryer through said first one of said two air outlets.

22. A construction as in claim 21 wherein the frame is provided with finger grip means thereon for aiding in manual removal of the frame and screen from the slideway.

23. A construction as in either claim 18 or claim 19 wherein said two parallel walls of the housing means are provided with aligned open-sided recesses, said air-directing valve member having shaft means integral therewith, and of a length greater than that of the valve member and adapted to enter into and be journalled in said aligned open-sided recesses while said valve member is positioned between said parallel walls; and said housing means including wall means that are selectively separable from or connectable to the remainder of the housing means, said selectively separable wall means being shaped and arranged to cooperate with said parallel walls, the shaft means, and the open-sided recesses, to complete said housing means and to retain said shaft means journalled in said open-sided recesses.

24. A construction as in either claim 18 or claim 19 wherein said air-directing valve member is operatively associated with a control handle therefor that is positioned exteriorly of said housing means.

25. A construction as in claim 24 including spaced abutments, on the exterior of said housing means and positioned across the path of selective movement of the control handle and adapted to be selectively engaged by the control handle to hold the valve member under compression force within the housing means selectively in one or the other of said two alternate positions for the valve member.

* * * * *